United States Patent [19]

Beckstrom et al.

[11] Patent Number: 4,475,274

[45] Date of Patent: Oct. 9, 1984

[54] METHOD OF MAKING AND INSTALLING A POURING FITMENT

[75] Inventors: Ronald D. Beckstrom, Fullerton; Chester C. Anderson, Santa Ana, both of Calif.

[73] Assignee: Hunt-Wesson Foods, Inc., Fullerton, Calif.

[21] Appl. No.: 396,024

[22] Filed: Jul. 7, 1982

[51] Int. Cl.[3] ..... B23P 11/02

[52] U.S. Cl. ..... 29/450; 29/453; 215/100 R; 215/100.5; 222/545; 222/562; 264/295; 264/296; 264/318

[58] Field of Search ..... 29/453, 450, 451, 445; 264/320, 295, 318, 296; 222/551, 562, 568, 545, 548, 567; 215/100 R, 100.5, 31, 258, 276

[56] References Cited

U.S. PATENT DOCUMENTS

| | | | |
|---|---|---|---|
| 2,507,638 | 5/1950 | Leahy | 264/249 X |
| 2,715,480 | 8/1955 | Livingstone | 222/562 UX |
| 2,785,841 | 3/1957 | Westgate | 215/100 R X |
| 2,834,497 | 5/1958 | Wolf . | |
| 2,848,145 | 8/1958 | Livingstone | 215/100 R X |
| 2,854,163 | 9/1958 | Barnby | 215/31 |
| 2,917,198 | 12/1959 | Beall, Jr. . | |
| 2,932,436 | 4/1960 | Dobbins | 222/562 X |
| 2,951,343 | 9/1960 | Mumford | 24/318 X |
| 2,964,208 | 12/1960 | Heyl et al. . | |
| 3,074,581 | 1/1963 | Livingstone | 215/100 R |
| 3,089,621 | 5/1963 | Livingstone | 222/551 X |
| 3,122,274 | 2/1964 | Quinche | 264/249 X |
| 3,136,458 | 6/1964 | Ruetz | 222/562 X |
| 3,311,275 | 3/1967 | Gibson | 222/567 |
| 3,325,034 | 6/1967 | Squire | 215/100.5 X |
| 3,338,448 | 8/1967 | Squire | 215/100.5 |
| 3,344,942 | 10/1967 | Hedgewick | 264/318 X |
| 3,405,439 | 10/1968 | Uemura | 264/296 X |
| 3,557,275 | 1/1971 | Longshaw et al. | 264/296 |
| 3,817,418 | 6/1974 | Mastronito | 215/31 X |
| 3,942,660 | 3/1976 | Paller | 215/31 |
| 4,196,819 | 4/1980 | Fontanaud | 222/568 X |

FOREIGN PATENT DOCUMENTS

| | | | |
|---|---|---|---|
| 1063482 | 8/1959 | Fed. Rep. of Germany | 222/551 |
| 1105956 | 12/1955 | France | 215/100.5 |

*Primary Examiner*—Charlie T. Moon

*Attorney, Agent, or Firm*—Pretty, Schroeder, Brueggemann & Clark

[57] ABSTRACT

A generally annular pouring fitment is forced into a closure, thereby deforming a lip of the fitment elastically and inelastically. The closure is then releasably secured to a container causing the fitment to permanently interlock with the container. When the closure is removed, the lip defines a pouring surface of a desired three-dimensional configuration.

19 Claims, 5 Drawing Figures

METHOD OF MAKING AND INSTALLING A POURING FITMENT

FIELD OF THE INVENTION

The present invention relates to pouring fitments that are used in combination with containers to prevent the liquid contents of the containers from dripping, and, more particularly, to a method of making and installing such fitments.

BACKGROUND OF THE INVENTION

When a liquid is poured from a container, it is often found that it is difficult to terminate pouring without having one or more drops of the liquid run down the outside of the container. This tendency to drip is largely a characteristic of the container itself, rather than a function of the pouring motion. Thus, it is known by those skilled in the art that dripping can be substantially eliminated by a combination of a properly contoured mouth or lip on the container and a non-wetting pouring surface on the lip. A well designed no-drip container will actually cause the last drops of a liquid to be pulled back into the container even if they have passed the highest point on the pouring surface.

Unfortunately, it has often been impractical to incorporate satisfactory non-drip characteristics in large numbers of mass produced containers. These containers, such as salad oil bottles, are often manufactured by a process that does not permit the desired lip configuration to be reliably and repeatedly formed at a reasonable cost. Moreover, the materials of which such containers are made are too easily wetted to effectively prevent drippage. Consumer dissatisfaction with the pour characteristics of these containers is aggravated by the fact that the containers are sometimes used over and over again to pour relatively small quantities. The dripped contents tend to accumulate on the outside of the container, leading to a messy and potentially unsanitary condition.

One known solution to the above problem is the use of a fitment, a small permanent attachment to the mouth of the container that forms the pouring surface. There are, however, a number of important problems and disadvantages associated with the use of known fitments. The manufacture of a fitment having the desired three-dimensional pouring surface is often an expensive proposition requiring a complex molding process. It is also difficult to obtain a good seal between the fitment and the container because of the relatively large tolerances generally associated with such containers. Leakage can occur between the fitment and the cap or closure of the containers.

It should also be appreciated that the addition of a fitment to a cap and closure packaging system necessarily converts that system from a two-element system to a three-element system. Tolerance requirements imposed by the fitment and assembly complexities attributable to the fitment must therefore be minimized if unacceptable costs are to be avoided.

The objective of the present invention is to provide a method of making and installing a fitment that overcomes the disadvantages of previously known fitments and satisfies the design criteria set forth above.

SUMMARY OF THE INVENTION

The above objective is accomplished by the present invention. One aspect of the invention resides in a method of making a fitment. First, a generally annular fitment is formed, preferably by molding it of plastic. The fitment is forced into a closure, thereby deforming a lip of the fitment, part of the deformation being plastic and part being inelastic.

Preferably, the closure defines an annular cradle into which the fitment is inserted axially. The fitment can be retained in the closure by a flexible radially extending foot that engages a threaded portion on an inside surface of the closure.

According to another aspect of the invention, the closure, containing the fitment, is releasably secured to the container, thereby permanently installing the fitment on the container. Preferably, a retainer portion of the fitment is elastically deformed and interlocks with a holding portion of the container. The fitment may define an annular recess that receives a holding portion of the container. Securement of the closure to the container may be accomplished by rotating the closure and thereby threading it onto the container.

As a final step in the process, the closure can be removed from the container, leaving the fitment in place. The foot is elastically deformed, disengaging the threaded surface, to permit the closure to be removed. After removal of the fitment from the closure, the lip assumes a three-dimensional shape in which it defines a desired three-dimensional pouring surface.

Other features and advantages of the present invention will become apparent from the following detailed description, taken in conjunction with the accompanying drawings, which illustrate, by way of example, the principles of the invention.

DESCRIPTION OF THE PREFERRED EMBODIMENT

Figure 1:
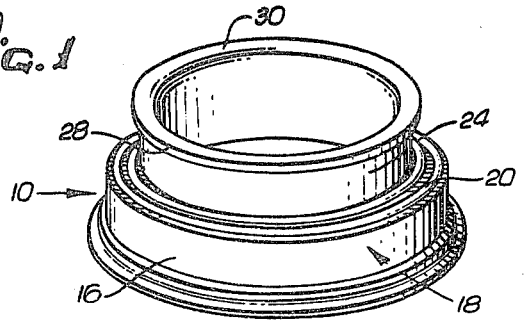
FIG. 1 is a perspective view of a fitment made in accordance with the present invention.
Figure 4:
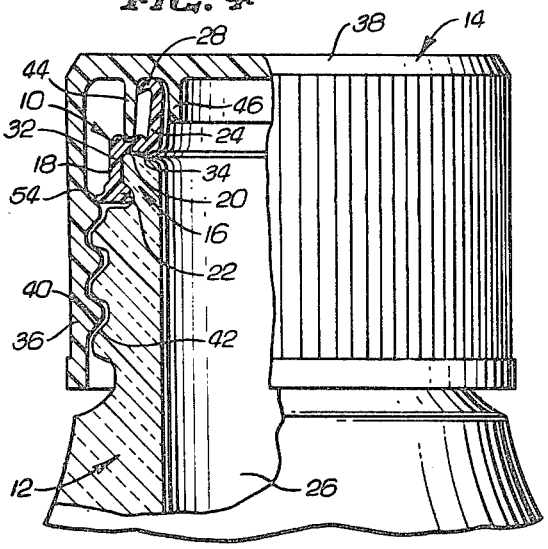
FIG. 4 is a partially broken away side elevation of the fitment and closure of FIG. 3 installed in a container, only a fragmentary upper portion of the container being shown.

A fitment 10, shown separately in FIG. 1, is used in combination with a container 12 and a closure 14, as shown in FIG. 4. The relationship of these components to each other when in use will be described first and then the preferred method of making and installing the fitment will be explained.

The fitment 10 includes a retainer portion 16 having an annular sidewall 18, a top segment 20, and a snap bead 22. Extending upwardly from the inner end of the top segment 20 is a ring 24 that forms a short tubular extension of an opening 26 at the top of the container 12. At the top of the ring 24 is an outwardly extending lip 28 that defines a no-drip pouring surface 30.

Figure 5:
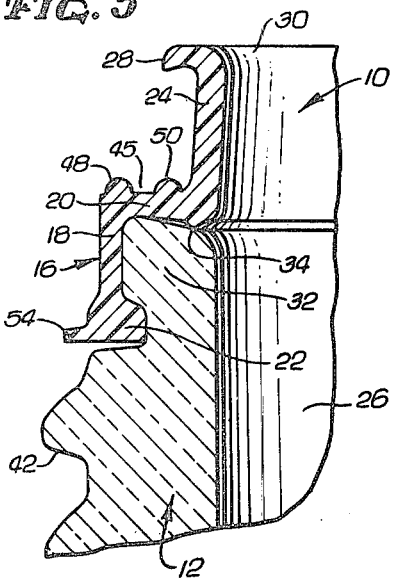
FIG. 5 is an enlarged fragmentary cross-sectional side view of the fitment and container of FIG. 4.

The retainer portion 16 of the fitment 10 defines an inwardly facing recess that receives a holding portion 32 of the container 12, as best shown in FIG. 5. Conforming to the shape of the holding portion 32, the top segment 20 extends downwardly as well as inwardly and the snap bead 22 fits under a lower surface of the holding portion 32. The retainer portion 16 must be stretched slightly to fit over the holding portion 32 and it thus grasps the holding portion resiliently, the snap bead 22 acting as a fulcrum. An annular sealing bead 34 on the bottom of the top portion 20 firmly engages the holding portion 32 in a high pressure, liquid-tight relationship.

The closure 14 has a cylindrical sidewall 36 and a flat top 38, as best shown in FIG. 4. It has an internal threaded surface 40 just below the holding portion 32 that mates with an external threaded surface 42 of the container 12.

On the inside of the closure 14 are two downwardly extending concentric annular projections 44 and 46 defining between them a downwardly facing annular cradle with an inner surface of approximately arcuate cross section that engages the pouring surface 30 of the lip 28. The dimensions and shape of the closure 14 are such that, when fully screwed onto the container 12, it will not permit the lip 28 to assume its relaxed configuration shown in FIG. 5. Instead, the lip 28 is bent slightly downwardly in an elastic manner by the closure 14. This bending of the lip 28 insures a tight seal despite any surface irregularities of the closure 14 and despite a range of possible positions of the closure relative to the container 12. When the closure 14 is removed from the container 12, the lip 28 returns to its desired configuration, presenting an effective pouring surface of the desired three-dimensional configuration, as shown in FIG. 5.

The outer projection 44 of the closure 14 forms a support member that is received by an upwardly facing circular positioning channel 45 (see FIG. 5) defined between two concentric positioning beads 48 and 50 on the top segment 20 of the retainer portion 16 of the fitment 10. This positioning channel 45 is disposed laterally between the sidewall 18 and the sealing bead 34. Thus, the closure 14, when installed in the container 12, tightens and pulls the sidewall 18 against the holding portion 32 of the container and exerts a downward force on the sealing bead 34, increasing the force attributable to the resiliance of the fitment 10 to prevent leakage between the fitment 10 and the container 12. The resultng force that constantly urges the lip 28 against the closure 14 is sufficient to prevent any leakage between the fitment 10 and the closure 14 and can eliminate the need for a soft gasket-like insert in the closure that otherwise would be required. The components need not be held to close tolerances and a satisfactory seal is formed by the sealing bead 34 and the snap bead 22.

An additional function of the support member 44 is to support the top 38 of the closure 14. Any downward force applied to the closure 14 would be resisted by this support member 44 and would prevent downward deflection of the top 38 that might otherwise result in undesired inelastic deformation of the lip 28 and its pour surface 30. The engagement of the support 44 by the channel 45 also stabilizes the closure 14 against lateral and radial movement.

Figure 2:
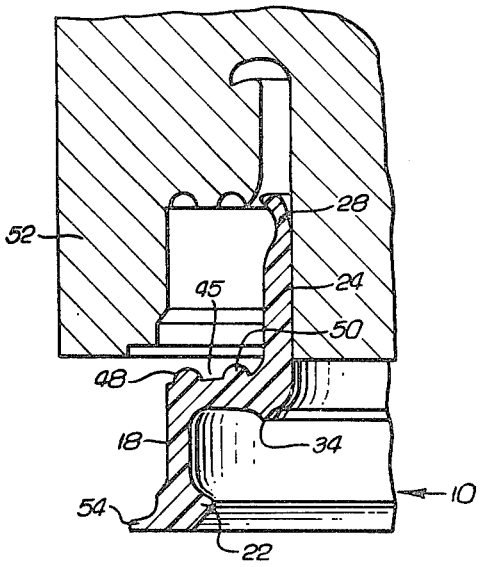
FIG. 2 is a fragmentary cross-sectional view of the fitment being withdrawn from a mold component.
Figure 3:
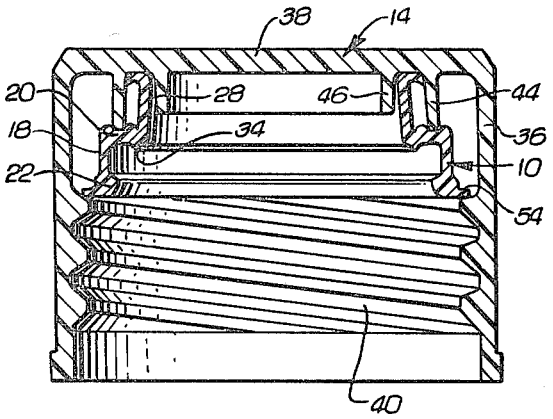
FIG. 3 is a cross-sectional side view of the fitment of FIGS. 1 and 2 installed in a closure.

The manufacture and installation of the fitment 10 will now be explained. The fitment 10 is injection strip molded of a relatively high elasticity plastic. When it is withdrawn from the mold 52, however, as shown in FIG. 2, the lip 28 is forced to assume a relatively upright, although slightly angled, position and will not, by itself, return to a position in which the pouring surface 30 has the desired configuration of FIG. 5 unless the mold 52 is of a relatively complex construction. But the lip 28 is reconformed, being bent outwardly and downwardly, when the fitment 10 is axially forced fully into the closure 14, as shown in FIG. 3, prior to being installed on the container 12. In this way, the fitment 10 is custom formed to mate with an individual closure 14 and deformed to the extent that it assumes the configuration shown in FIG. 5 when removed from the closure 14. The interior surface of the closure 14 is configured to produce the desired deformation of the lip 28.

Once the fitment 10 has been temporarily installed in the closure 14 in this way, it is retained by a small radially projecting, flexible, annular installation foot 54 that engages the top of the threaded surface 40 of the closure 14, as shown in FIG. 3. The fitment 10 is then installed on the container 12 by simply threading the closure 14 onto the container, as shown in FIG. 4. The retainer portion 16 of the fitment 10 flexes elastically sufficiently to permit the snap bead 22 to pass over the holding portion 32 of the container 12 so that the retainer portion and the holding portion interlock. After the fitment 10 has been installed on the container 12 in this way, the installation is permanent. When the closure 14 is removed from the container 12, the foot 54 flexes elastically by bending upwardly at its outer end, allowing it to pass over the threaded surface 40 of the closure 14. Since the deformation of the lip 28 is partially elastic and partially inelastic, it returns part way toward the shape it had before being forced into the closure 14.

A plastic composition that has been found to work well for both the fitment 10 and the closure 14 is a mixture of 70 to 90 percent polypropylene. The preferred physical properties of this mixture are as follows:

melt index: 8.0 to 12.0
tensile at yield: 4500 to 5500 psi
flex modulous: 150,000 to 300,000 psi
izod impact notched at 23° C.: 0.5 to 1.0 ft. lb.
density: 9.04 to 9.08 g/cm$^3$
deflection temperature at 66 psi: 220° to 240° F.

There may, of course, be other plastics that are suitable and the scope of the invention is not limited to this particular formulation.

It will be noted that the invention provides a simple pouring fitment 10 that does not require that close tolerances be maintained in either the container 12 or the closure 14. Leakage between the container 12 and the fitment 10 or between the fitment 10 and the closure 14 is prevented and the fitment is easily installed on the container by simply installing the closure in the usual manner.

While a particular form of the invention has been illustrated and described, it will be apparent that various modifications can be made without departing from the spirit and scope of the invention.

We claim:

1. A method of making and installing a pouring fitment comprising:

forming a generally annular fitment having a retainer portion and a lip;

forcing said fitment into a closure and thereby deforming said lip to form a pouring surface thereon, part of said deformation being elastic and part of said deformation being inelastic, whereby said lip defines a pouring surface of a desired three-dimensional configuration when separated from said closure; and releasably securing said closure to a container and thereby permanently installing said fitment on said container.

2. The method of claim 1 wherein said fitment is formed of plastic by molding.

3. The method of claim 1 wherein said fitment is forced axially into an annular cradle defined by said closure.

4. A method of making and installing a pouring fitment comprising:

forming a generally annular fitment having a retainer portion, a ring extending upwardly from said retainer portion and a lip extending from said ring;

forcing said fitment into a closure and thereby deforming said lip to form a pouring surface thereon, part of said deformation being elastic and part of said deformation being inelastic; and releasably securing said closure to a container and thereby permanently installing said fitment on said container.

5. The method of claim 4 wherein said fitment is formed of plastic by molding.

6. The method of claim 4 wherein said closure is secured to said container by rotating it and thereby threading it onto said container.

7. The method of claim 4 wherein said lip is deformed by forcing it axially into an annular cradle defined by said closure.

8. The method of claim 4 wherein said lip is deformed by forcing it upwardly and axially into an annular cradle defined by said closure and thereby bending said lip outwardly and downwardly.

9. The method of claim 4 comprising the further step of removing said closure from said container, whereby said lip is caused to define a pouring surface of a desired three-dimensional configuration.

10. A method of making and installing a pouring fitment comprising:

forming a fitment having a retainer portion defining an annular recess, a ring extending upwardly from said retainer portion and a lip extending from said ring;

forcing said fitment into a closure and thereby deforming said lip to form a pouring surface thereon, part of said deformation being elastic and part of said deformation being inelastic; and releasably securing said closure to a container and thereby elastically deforming said retainer portion to interlock with a holding portion of said container in said recess.

11. The method of claim 10 wherein said fitment is formed of plastic by molding.

12. The method of claim 10 wherein said closure is secured to said container by rotating it and thereby threading it onto said container.

13. The method of claim 10 wherein said lip is deformed by forcing it axially into an annular cradle defined by said closure.

14. The method of claim 10 wherein said lip is deformed by forcing it axially and upwardly into an annular cradle defined by said closure and thereby bending said lip outwardly and downwardly.

15. The method of claim 10 comprising the further step of removing said closure from said container, whereby said lip is caused to define a pouring surface of a desired three-dimensional configuration.

16. A method of making and installing a pouring fitment comprising:

forming a generally annular fitment having a retainer portion, a ring extending upwardly from said retainer portion, a lip extending from said ring, and a radially outwardly extending flexible foot;

forcing said fitment into a closure, thereby deforming said lip to form a pouring surface thereon, part of said deformation being elastic and part of said deformation being inelastic, and causing said foot to temporarily retain said fitment in said closure;

releasably securing said closure to a container and thereby permanently installing said fitment on said container; and removing said closure from said container, thereby separating said closure from said fitment and causing said lip to define a pouring surface of a desired three-dimensional configuration.

17. The method of claim 16 wherein said fitment is permanently installed on said container by elastically deforming said fitment and thereby causing it to interlock with a holding portion of said container.

18. The method of claim 16 wherein said lip is deformed by forcing it upwardly into an annular cradle defined by said closure and thereby bending said lip outwardly and downwardly.

19. A method of making and installing a pouring fitment comprising:

molding a generally annular plastic fitment having a retainer portion defining a recess, a ring extending upwardly from said retainer portion, a lip extending from said ring, and a radially outwardly extending annular foot;

forcing said fitment into a closure, thereby deforming said lip to form a pouring surface thereon, part of said deformation being elastic and part of said deformation being inelastic, and causing said foot to engage an internal threaded portion of said closure to temporarily retain said fitment in said closure;

releasably screwing said closure onto a container and thereby permanently installing said fitment on said container by elastically deforming said retainer portion and causing it to interlock with a holding portion of said container; and removing said closure from said container thereby elastically deforming said foot and separating said closure from said fitment, causing said lip to define a pouring surface of a desired three-dimensional configuration.

* * * * *